US008296879B2

(12) United States Patent
Lin

(10) Patent No.: US 8,296,879 B2
(45) Date of Patent: Oct. 30, 2012

(54) FOLDABLE BED

(76) Inventor: Eric Lin, Taipei (TW)

( * ) Notice: Subject to any disclaimer, the term of this patent is extended or adjusted under 35 U.S.C. 154(b) by 149 days.

(21) Appl. No.: 12/945,938

(22) Filed: Nov. 15, 2010

(65) Prior Publication Data

US 2012/0117727 A1 May 17, 2012

(51) Int. Cl.
*A47C 19/04* (2006.01)
*A47C 17/64* (2006.01)
*A47C 17/76* (2006.01)

(52) U.S. Cl. ..... 5/111; 5/110; 5/112; 5/114; 5/117

(58) Field of Classification Search ..... 5/110–117
See application file for complete search history.

(56) References Cited

U.S. PATENT DOCUMENTS 6,553,586 B1 4/2003 Lin
6,618,879 B1 * 9/2003 Wu ..... 5/111
* cited by examiner

*Primary Examiner* — Robert G Santos
*Assistant Examiner* — Brittany Wilson
(74) *Attorney, Agent, or Firm* — Alan Kamrath; Kamrath IP Lawfirm, PA

(57) ABSTRACT

A foldable bed includes a plurality of connecting bars, a plurality of support bars, and a plurality of stand units. Each of the stand units includes two pivotally connected support legs each having a first end provided with an upper support portion, a second end provided with a lower support portion, and a middle section provided with a pivot portion. Each of the stand units further includes two clamping brackets each mounted on the respective support leg, and two vibration absorbers each mounted in the respective clamping bracket. Thus, when the two support legs are expanded, each of the vibration absorbers on one of the support legs abuts the pivot portion of the other one of the support legs so that the support legs are combined solidly and stably so as to enhance the structural strength of each of the stand units.

10 Claims, 8 Drawing Sheets

FOLDABLE BED

BACKGROUND OF THE INVENTION

1. Field of the Invention

The present invention relates to a bed and, more particularly, to a foldable bed.

2. Description of the Related Art

A conventional foldable bed comprises a support frame, a bed surface mounted on the support frame, and a plurality of stand units each pivotally connected with the support frame. Each of the stand units includes two support legs pivotally connected with each other. The two support legs of each of the stand units form a substantially X-shaped structure to support the support frame. However, the two support legs of each of the stand units are easily pivoted and expanded outward by the user's gravity so that each of the stand units has an instable structure and easily produces vibration or sway.

The closest prior art reference of which the applicant is aware was disclosed in his U.S. Pat. No. 6,553,586-B1, filed on Dec. 26, 2001, entitled "Folding Bed Frame".

BRIEF SUMMARY OF THE INVENTION

In accordance with the present invention, there is provided a foldable bed, comprising a plurality of connecting bars, a plurality of support bars connected with the connecting bars, a plurality of stand units pivotally connected with the connecting bars by a plurality of pivot brackets, and a bed surface mounted between and supported by the connecting bars and the support bars. Each of the stand units includes two support legs pivotally connected with each other. Each of the two support legs of each of the stand units has a first end provided with an upper support portion and a second end provided with a lower support portion. Each of the two support legs of each of the stand units has a middle section provided with a pivot portion located between the upper support portion and the lower support portion. Each of the stand units further includes two clamping brackets each mounted on a respective one of the two support legs, and two vibration absorbers each mounted in a respective one of the two clamping brackets.

The pivot portion of each of the two support legs is bent and curved transversely so that the pivot portions of the two support legs intersect each other. Thus, each of the two clamping brackets and each of the two vibration absorbers on one of the two support legs are movable to abut the pivot portion of the other one of the two support legs. Each of the upper support portion and the lower support portion of each of the two support legs has a bent and curved shape so that each of the two support legs of each of the stand units has a substantially S-shaped profile. Each of the two clamping brackets of each of the stand units is located between the upper support portion and the pivot portion of the respective support leg. The two support legs of each of the stand units have the same shape and size. Each of the connecting bars has a free end provided with a positioning rod. Each of the support bars has two opposite ends each provided with a positioning hole locked onto the positioning rod of a respective one of the connecting bars. The positioning hole of each of the support bars has a bottom provided with an opening to allow entrance of the positioning rod of the respective connecting bar.

According to the primary advantage of the present invention, the foldable bed can be collapsed when not in use.

According to another advantage of the present invention, when the two support legs of each of the stand units are expanded completely, each of the two clamping brackets and each of the two vibration absorbers on one of the two support legs abut and clamp the pivot portion of the other one of the two support legs so that the two support legs of each of the stand units are combined solidly and stably so as to enhance the structural strength and stability of each of the stand units, thereby preventing the stand units from producing vibration or sway.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
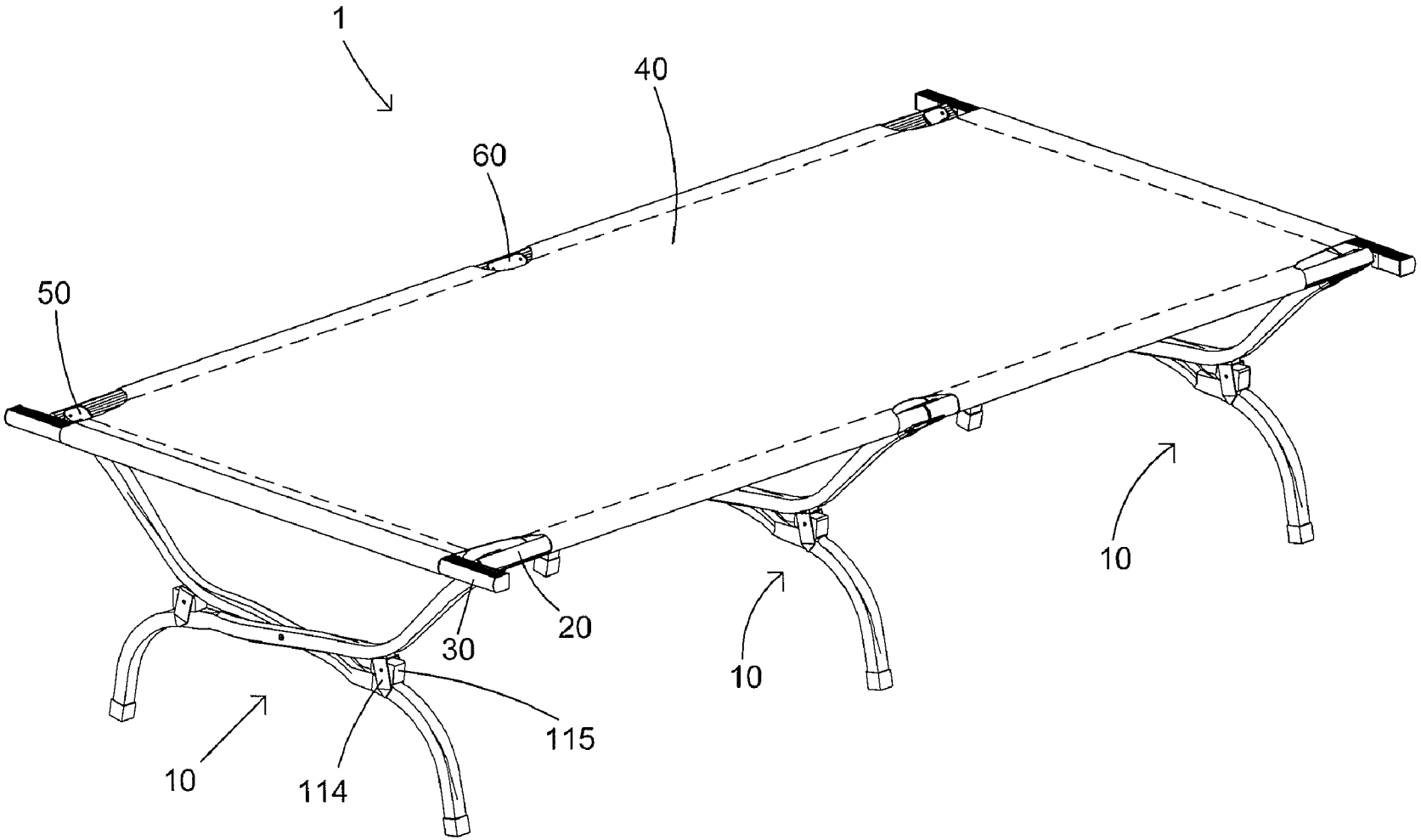
FIG. 1 is a perspective view of a foldable bed in accordance with the preferred embodiment of the present invention.
Figure 2:
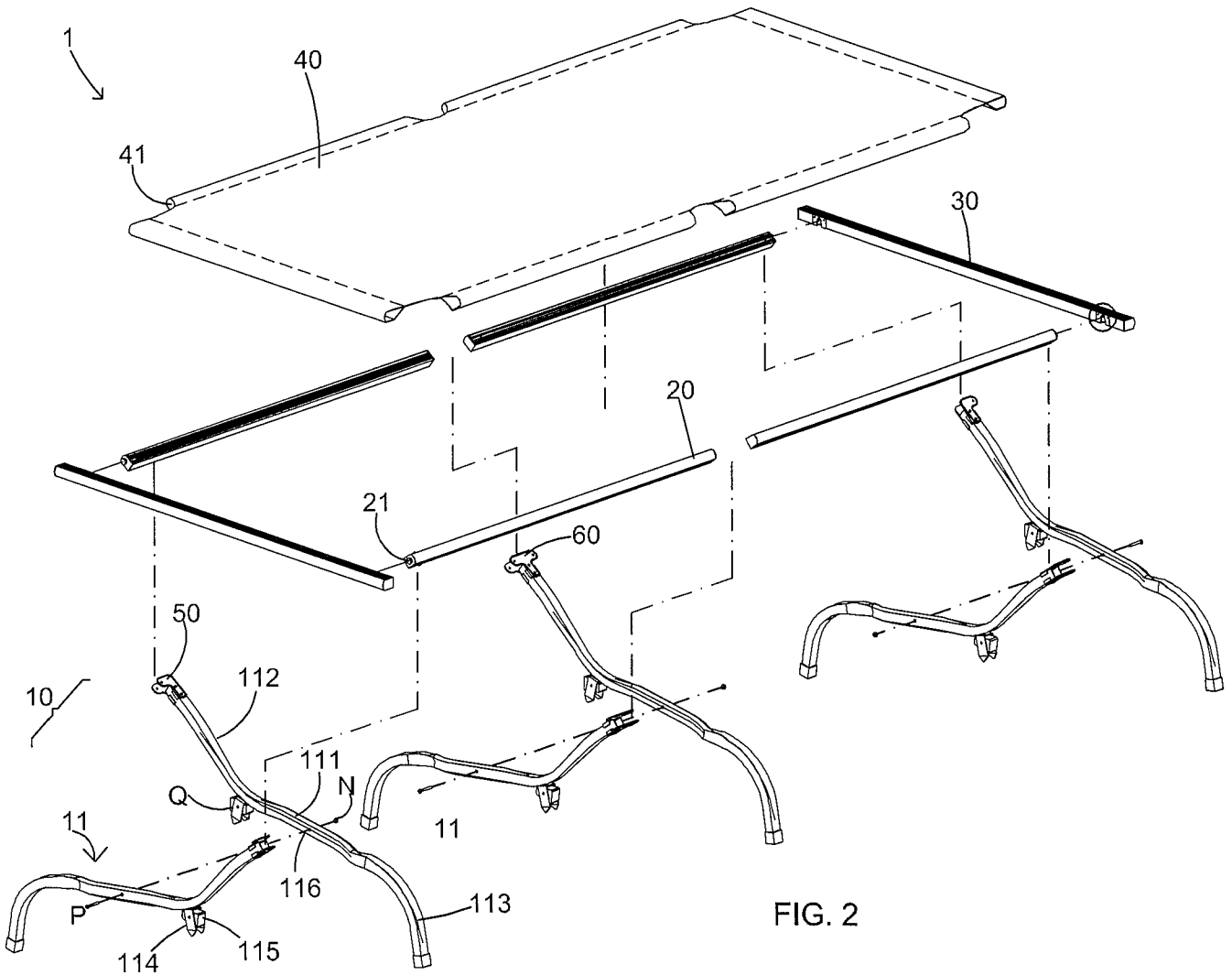
FIG. 2 is an exploded perspective view of the foldable bed as shown in FIG. 1.
Figure 3:
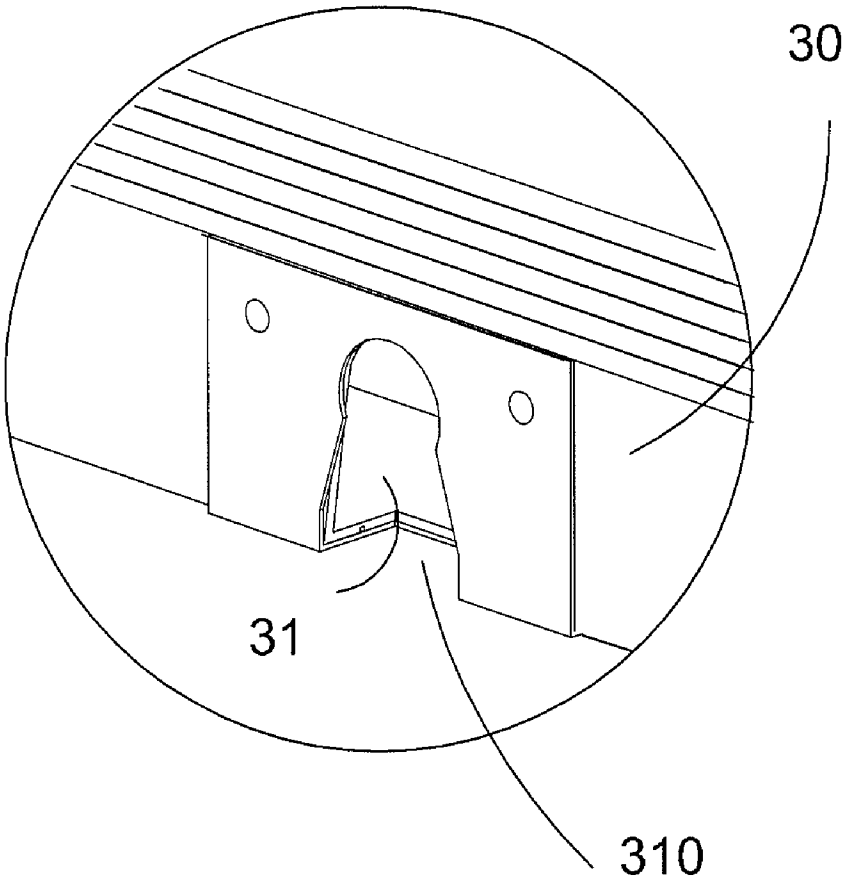
FIG. 3 is a locally perspective enlarged view of a support bar of the foldable bed as shown in FIG. 2.

Referring to the drawings and initially to FIGS. 1-6, a foldable bed 1 in accordance with the preferred embodiment of the present invention comprises a plurality of connecting bars 20, a plurality of support bars 30 connected with the connecting bars 20, a plurality of stand units 10 pivotally connected with the connecting bars 20 by a plurality of pivot brackets 50 and 60, and a bed surface 40 mounted between and supported by the connecting bars 20 and the support bars 30.

In the preferred embodiment of the present invention, the foldable bed 1 comprises four connecting bars 20, two support bars 30, three stand units 10, four pivot brackets 50 and two pivot brackets 60. In addition, the connecting bars 20 and the support bars 30 form a rectangular structure.

Each of the stand units 10 includes two support legs 11 pivotally connected with each other. The two support legs 11 of each of the stand units 10 have the same shape and size. Each of the two support legs 11 of each of the stand units 10 has a first end provided with an upper support portion 112 and a second end provided with a lower support portion 113. Each of the upper support portion 112 and the lower support portion 113 of each of the two support legs 11 is bent to have a curved shape so that each of the two support legs 11 of each of the stand units 10 has a substantially S-shaped profile. The upper support portion 112 of each of the two support legs 11 is pivotally attached to a respective one of the connecting bars 20 by one of the pivot brackets 50 and 60.

Each of the two support legs 11 of each of the stand units 10 has a middle section provided with a pivot portion 111 located between the upper support portion 112 and the lower support portion 113. The pivot portion 111 of each of the two support legs 11 has a middle position provided with a pivot hole 116, and each of the stand units 10 further includes a fastening bolt "P" extending through the pivot hole 116 of each of the two support legs 11, and a fastening nut "N" screwed onto the fastening bolt "P" so that the pivot portions 111 of the two support legs 11 are pivotally connected with each other.

Figure 4:
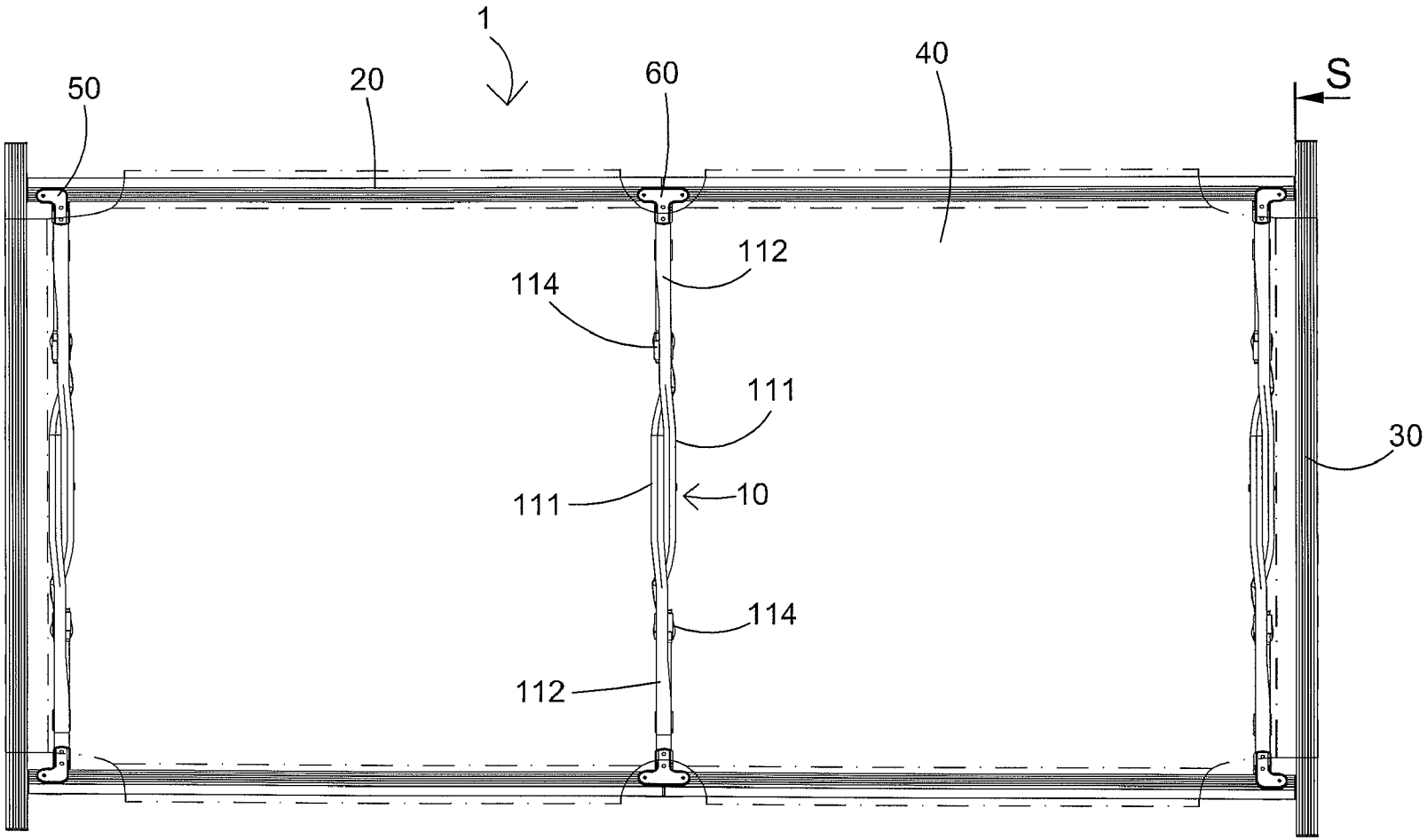
FIG. 4 is a top view of the foldable bed as shown in FIG. 1.

Each of the stand units 10 further includes two clamping brackets 114 each mounted on a respective one of the two support legs 11, and two vibration absorbers 115 each mounted in a respective one of the two clamping brackets 114. Each of the two vibration absorbers 115 of each of the stand units 10 is pivotally connected with the respective clamping bracket 114 by a pin "Q". Each of the two clamping brackets 114 of each of the stand units 10 is located between the upper support portion 112 and the pivot portion 111 of the respective support leg 11. The pivot portion 111 of each of the two support legs 11 is bent and curved transversely so that the pivot portions 111 of the two support legs 11 intersect each other as shown in FIG. 4. Thus, each of the two clamping brackets 114 and each of the two vibration absorbers 115 on one of the two support legs 11 are movable to abut the pivot portion 111 of the other one of the two support legs 11 as shown in FIGS. 5 and 6.

Each of the connecting bars 20 has a free end provided with a positioning rod 21. Each of the support bars 30 has two opposite ends each provided with a positioning hole 31 (see FIG. 3) locked onto the positioning rod 21 of a respective one of the connecting bars 20. The positioning hole 31 of each of the support bars 30 has a bottom provided with an opening 310 to allow entrance of the positioning rod 21 of the respective connecting bar 20. The bed surface 40 has a periphery provided with a plurality of mounting holes 41 mounted on the connecting bars 20 and the support bars 30.

Figure 5:
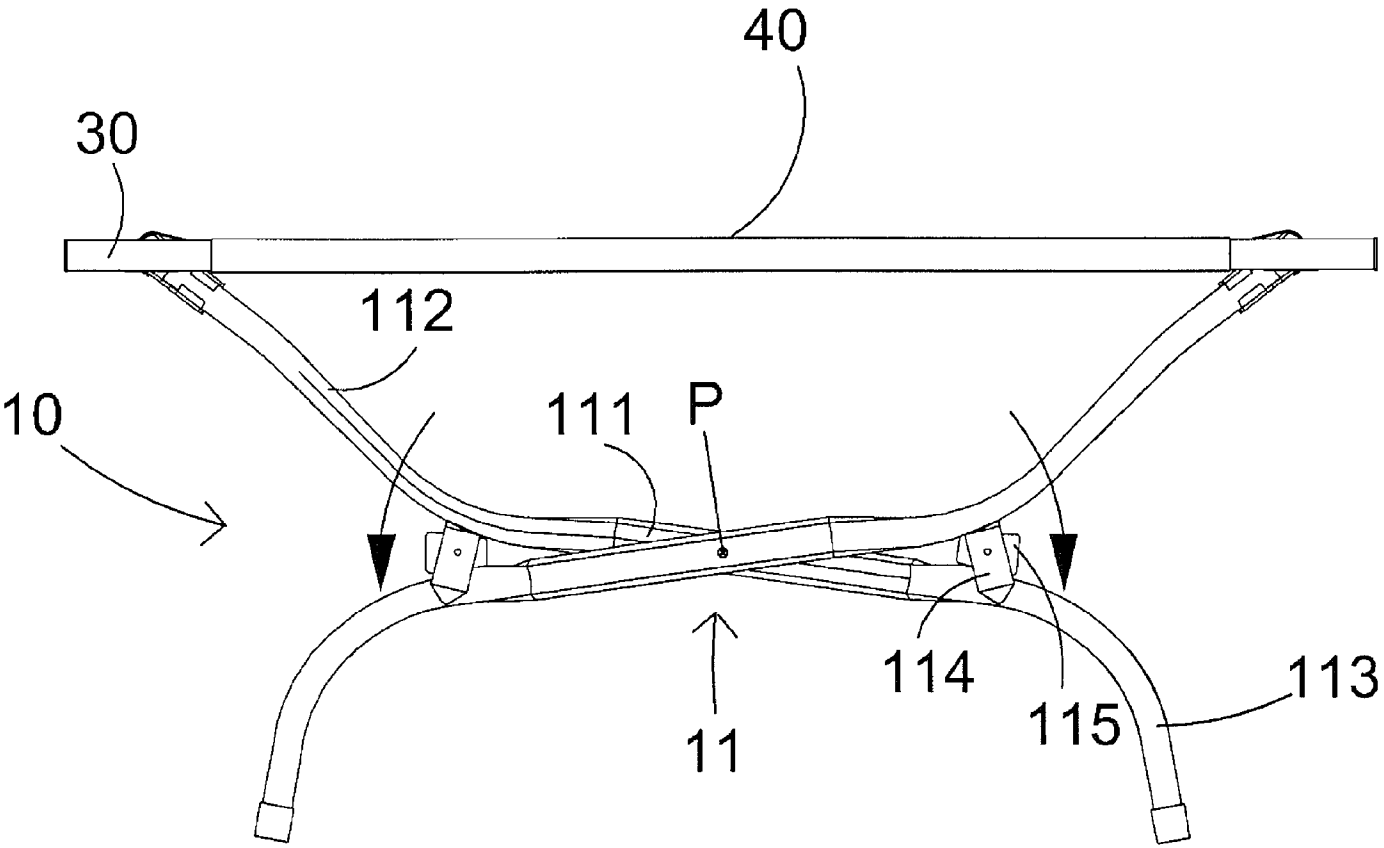
FIG. 5 is a side view of the foldable bed as shown in FIG. 1.

As shown in FIG. 5, each of the two clamping brackets 114 and each of the two vibration absorbers 115 on one of the two support legs 11 are movable to abut and clamp the pivot portion 111 of the other one of the two support legs 11 so that the two support legs 11 of each of the stand units 10 are combined solidly and stably to enhance the structural strength of each of the stand units 10, thereby preventing each of the stand units 10 from producing vibration or instability.

Figure 6:
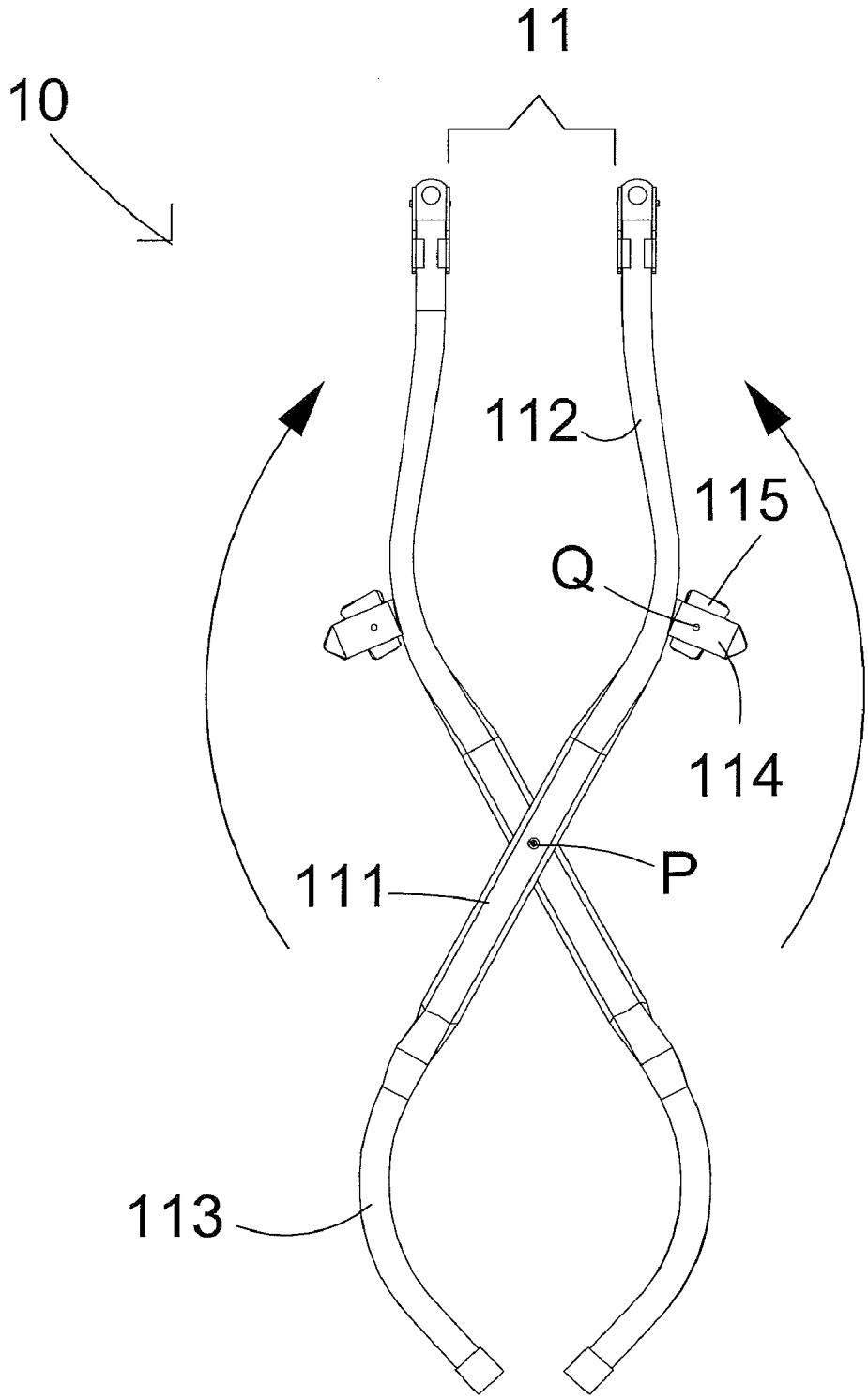
FIG. 6 is a folded view of the foldable bed as shown in FIG. 5.

As shown in FIG. 6, the two support legs 11 of each of the stand units 10 are pivoted about the fastening bolt "P" to collapse each of the stand units 10 when not in use.

Figure 7:
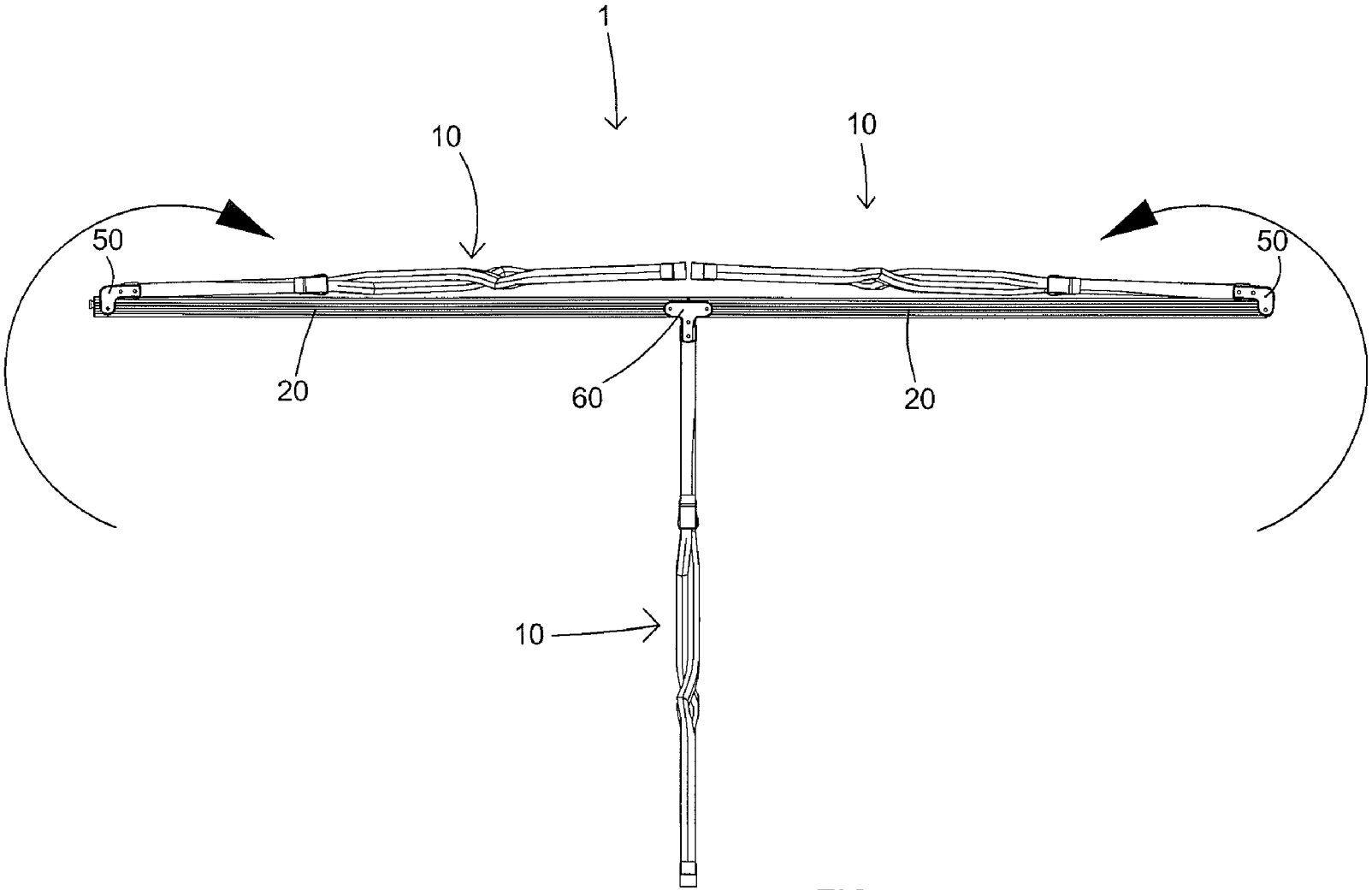
FIG. 7 is a partially front folded view of the foldable bed as shown in FIG. 1.
Figure 8:
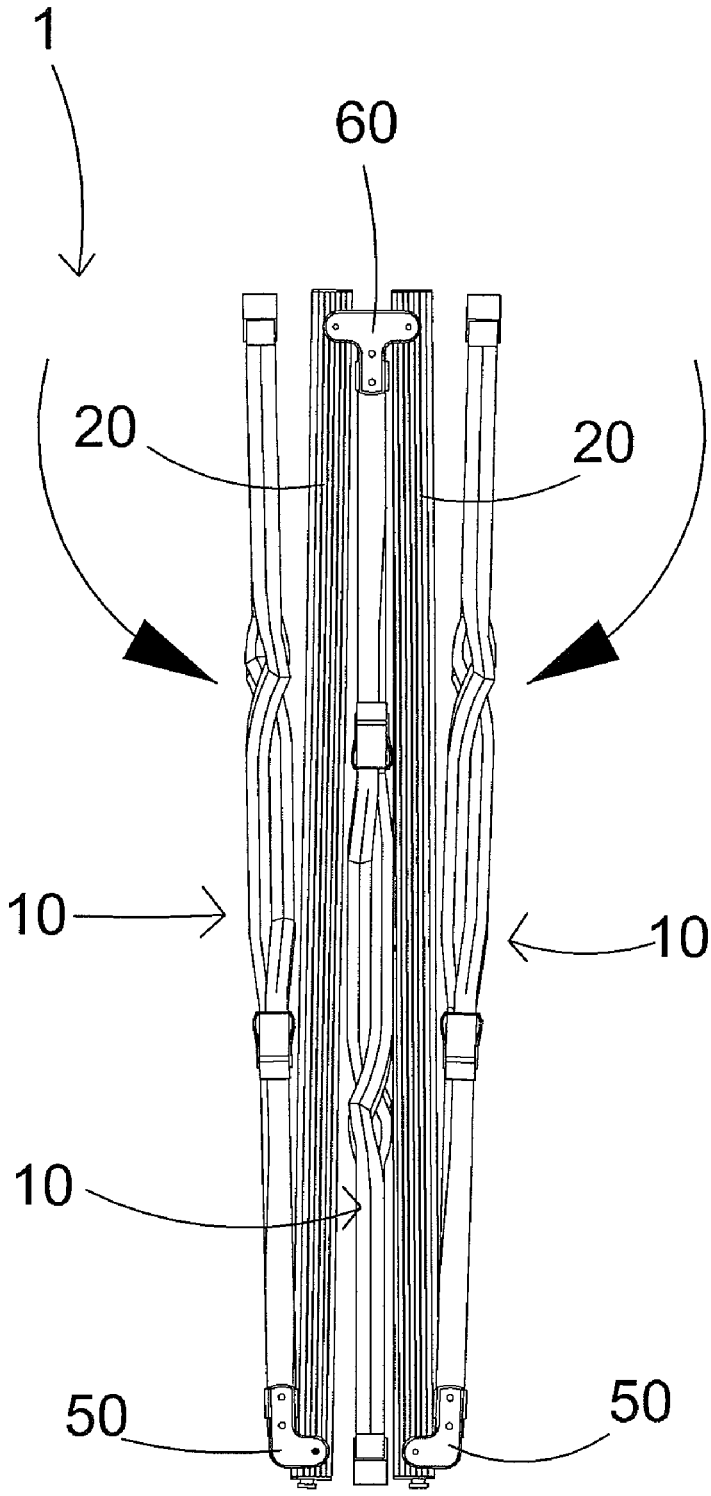
FIG. 8 is a schematic operational folded view of the foldable bed as shown in FIG. 7.

In folding of the foldable bed 1, referring to FIGS. 7 and 8 with reference to FIGS. 1-6, two outer stand units 10 are pivoted outward and upward by pivoting motion of the pivot brackets 50 and are then moved downward to abut the connecting bars 20 as shown in FIG. 7. Then, the connecting bars 20 are pivoted inward and downward by pivoting motion of the pivot brackets 60 and are then moved toward each other to abut a middle stand unit 10 as shown in FIG. 8 so as to collapse the foldable bed 1.

Accordingly, when the two support legs 11 of each of the stand units 10 are expanded completely, each of the two clamping brackets 114 and each of the two vibration absorbers 115 on one of the two support legs 11 abut and clamp the pivot portion 111 of the other one of the two support legs 11 so that the two support legs 11 of each of the stand units 10 are combined solidly and stably so as to enhance the structural strength and stability of each of the stand units 10, thereby preventing the stand units 10 from producing vibration or sway.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A foldable bed comprising:

a plurality of connecting bars;

a plurality of support bars connected with the plurality of connecting bars;

a plurality of stand units pivotally connected with the plurality of connecting bars by a plurality of pivot brackets; and a bed surface mounted between and supported by the plurality of connecting bars and the plurality of support bars, wherein:

each of the plurality of stand units includes two support legs pivotally connected with each other;

each of the two support legs of each of the plurality of stand units has a first end provided with an upper support portion and a second end provided with a lower support portion;

each of the two support legs of each of the plurality of stand units has a middle section provided with a pivot portion located between the upper support portion and the lower support portion;

each of the plurality of stand units further includes two clamping brackets each mounted on a respective one of the two support legs, and two vibration absorbers each mounted in a respective one of the two clamping brackets;

the pivot portion of each of the two support legs is bent and curved transversely so that the pivot portions of the two support legs intersect each other; and each of the two clamping brackets and each of the two vibration absorbers on one of the two support legs are movable to abut the pivot portion of the other one of the two support legs.

2. The foldable bed of claim 1, wherein:

each of the upper support portion and the lower support portion of each of the two support legs has a bent and curved shape; and each of the two support legs of each of the stand units has a substantially S-shaped profile.

3. The foldable bed of claim 1, wherein each of the two clamping brackets of each of the plurality of stand units is located between the upper support portion and the pivot portion of the respective support leg.

4. The foldable bed of claim 1, wherein the two support legs of each of the plurality of stand units have the same shape and size.

5. The foldable bed of claim 1, wherein:

each of the plurality of connecting bars has a free end provided with a positioning rod; and each of the plurality of support bars has two opposite ends each provided with a positioning hole locked onto the positioning rod of a respective one of the plurality of connecting bars.

6. The foldable bed of claim 5, wherein the positioning hole of each of the plurality of support bars has a bottom provided with an opening to allow entrance of the positioning rod of the respective connecting bar.

7. The foldable bed of claim 1, wherein the bed surface has a periphery provided with a plurality of mounting holes mounted on the plurality of connecting bars and the plurality of support bars.

8. The foldable bed of claim 1, wherein the upper support portion of each of the two support legs is pivotally attached to a respective one of the plurality of connecting bars by one of the plurality of pivot brackets.

9. The foldable bed of claim 1, wherein:

the pivot portion of each of the two support legs has a middle position provided with a pivot hole;

each of the plurality of stand units further includes:

a fastening bolt extending through the pivot hole of each of the two support legs; and a fastening nut screwed onto the fastening bolt; and the pivot portions of the two support legs are pivotally connected with each other.

10. The foldable bed of claim 1, wherein each of the two vibration absorbers of each of the plurality of stand units is pivotally connected with the respective clamping bracket by a pin.

* * * * *